US009506177B2

(12) United States Patent
Lee et al.

(10) Patent No.: US 9,506,177 B2
(45) Date of Patent: Nov. 29, 2016

(54) WASHING MACHINE

(71) Applicant: LG ELECTRONICS INC., Seoul (KR)

(72) Inventors: Kyubum Lee, Seoul (KR); Youngjong Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 194 days.

(21) Appl. No.: 14/240,553

(22) PCT Filed: Nov. 1, 2012

(86) PCT No.: PCT/KR2012/009109

§ 371 (c)(1),
(2) Date: Feb. 24, 2014

(87) PCT Pub. No.: WO2013/066066

PCT Pub. Date: May 10, 2013

(65) Prior Publication Data

US 2014/0230496 A1 Aug. 21, 2014

(30) Foreign Application Priority Data

Nov. 3, 2011 (KR) ..... 10-2011-0114146

(51) Int. Cl.

| | |
|---|---|
| ***D06F 13/00*** | (2006.01) |
| ***D06F 13/02*** | (2006.01) |
| ***D06F 13/04*** | (2006.01) |
| ***D06F 13/06*** | (2006.01) |
| ***D06F 13/08*** | (2006.01) |
| ***D06F 17/04*** | (2006.01) |
| ***D06F 17/06*** | (2006.01) |
| ***D06F 17/08*** | (2006.01) |
| ***D06F 17/10*** | (2006.01) |
| ***D06F 37/30*** | (2006.01) |
| ***D06F 37/40*** | (2006.01) |

(52) U.S. Cl.

CPC ..... *D06F 17/08* (2013.01); *D06F 13/00* (2013.01); *D06F 13/02* (2013.01); *D06F 13/04* (2013.01); *D06F 13/06* (2013.01); *D06F 13/08* (2013.01); *D06F 17/04* (2013.01); *D06F 17/06* (2013.01); *D06F 17/10* (2013.01); *D06F 37/30* (2013.01); *D06F 37/40* (2013.01)

(58) Field of Classification Search

CPC ..... D06F 13/00; D06F 13/02; D06F 13/04; D06F 13/06; D06F 13/08; D06F 17/04; D06F 17/06; D06F 17/08; D06F 17/10; D06F 37/30; D06F 37/40

USPC ..... 68/23.5, 53, 54, 131, 132, 133, 134, 68/183, 207

See application file for complete search history.

(56) References Cited

U.S. PATENT DOCUMENTS

| | | | |
|---|---|---|---|
| 5,595,072 | A | 1/1997 | Bai et al. |
| 5,727,404 | A | 3/1998 | Cho |
| 5,829,276 | A | 11/1998 | Suh et al. |
| 5,950,460 | A | 9/1999 | Oh |

FOREIGN PATENT DOCUMENTS

KR 10-1999-0043525 A 6/1999

*Primary Examiner* — Michael Barr
*Assistant Examiner* — Levon J Shahinian
(74) *Attorney, Agent, or Firm* — Dentons US LLP

(57) ABSTRACT

A washing machine includes a cabinet for forming the appearance, a tub provided in the cabinet, a drum rotatably provided in the tub, a pulsator rotatably provided in the drum, a driving motor mounted outside the tub, and rotating the drum and the pulsator, and a water flow forming means provided below the pulsator, and forming a water flow ejected into the drum as an upstream flow.

10 Claims, 6 Drawing Sheets

WASHING MACHINE

This application is a 35 USC §371 National Stage entry of International Application No. PCT/KR2012/009109, filed on Nov. 1, 2012, and claims priority of Korean Application No. KR 10-2011-0114146 filed Nov. 3, 2011, which are each hereby incorporated by reference in their entirety.

TECHNICAL FIELD

The present disclosure relates to a washing machine, and particularly, to a washing machine having a structure capable of moving laundry by forming an ejection water flow in a drum.

BACKGROUND ART

Generally, a washing machine operates to forcibly move laundry inside a drum, by forming a water flow using a mechanical force of a pulsator. Here, the pulsator rotates by receiving a driving force of a driving motor in a state where detergent, washing water and the laundry are introduced into the drum.

In the washing machine, a washing process is performed as the laundry undergoes a physical reaction such as frictions or impacts. Furthermore, the washing process is performed through a chemical reaction between the detergent and the laundry. And, the chemical reaction between the detergent and the laundry is accelerated as the laundry moves in the drum.

The pulsator is rotated by a driving motor, and is configured to form various types of water flows in the drum through forward and backward rotations. In order to form a more powerful water flow, the pulsator may be provided with a means for ejecting a water flow.

The pulsator may eject a water flow in various manners. As an example, a water flow is formed by a centrifugal force of the rotating pulsator, and the water flow is ejected by the centrifugal force. However, in this case, there is a problem that an ejection pressure is insufficient because a water flow rotates by a centrifugal force.

As another example, a water flow can be ejected by providing an additional fan at the pulsator. However, such method has the following problems. Firstly, the pulsator has a complicated structure. Secondly, an ejection pressure is not sufficient, because a water flow formed by the fan also rotates.

DISCLOSURE OF INVENTION

Technical Problem

Therefore, an aspect of the detailed description is to provide a washing machine having a simplified structure, and provided with a water flow forming means for forming a water flow of a high ejection pressure.

Another aspect of the detailed description is to provide a washing machine capable of using a small amount of washing water and reducing abrasion of laundry, by forming a water flow of a high ejection pressure and thereby maintaining the level of washing water inside a drum in an equilibrium state.

Still another aspect of the detailed description is to provide a washing machine having a water flow forming means which can release an twisted state of laundry, by ejecting a water flow from a pulsator as an upstream flow.

Yet still another aspect of the detailed description is to provide a washing machine capable of enhancing a washing performance by forming a water flow of a high ejection pressure, and thereby allowing detergent introduced into a drum to circulate more smoothly.

Solution to Problem

To achieve these and other advantages and in accordance with the purpose of this specification, as embodied and broadly described herein, there is provided a washing machine, comprising: a cabinet for forming the appearance; a tub provided in the cabinet; a drum rotatably provided in the tub; a pulsator rotatably provided in the drum; a driving motor mounted outside the tub, and rotating the drum and the pulsator; and a water flow forming means provided below the pulsator, and forming a water flow ejected into the drum as an upstream flow.

The water flow forming means may comprise a centrifugal blade portion configured to form an ejection pressure using a centrifugal force; and a guide portion configured to guide a water flow pressurized by the centrifugal blade portion to be ejected through the pulsator.

The centrifugal blade portion and the pulsator may be integrally rotated by the driving motor. And, the guide portion may be fixed to the drum, and may be independently rotated from the centrifugal blade portion and the pulsator.

Through the guide portion, a water flow pressurized by a centrifugal force due to rotation of the centrifugal blade portion, may be formed as an upstream flow having a high ejection pressure.

The centrifugal blade portion may comprise an upper surface; a lower surface having an inlet at a central part thereof; and a plurality of blades extending in a radius direction between the upper surface and the lower surface. Water introduced through the inlet may be guided to a circumferential direction by the blades, and may be pressurized by a centrifugal force due to rotation of the centrifugal blade portion.

The centrifugal blade portion may be mounted to an inner lower side of the guide portion. The guide portion may include an outlet formed at a central part thereof; and a plurality of guide blades protruding towards the centrifugal blade portion at the periphery of the outlet, and extending in a radial direction. A water flow pressurized by the centrifugal blade portion in a circumferential direction, may be formed as an upstream flow by the guide blades to thereby be discharged through the outlet.

The upper surface and the plurality of blades of the centrifugal blade portion may be integrally formed. Alternatively, the upper surface, the lower surface and the plurality of blades may be integrally formed.

A connection opening through which water between the tub and the drum flows to the inlet, may be formed on a lower surface of the drum.

The water between the tub and the drum may flow to the inlet through the connection opening, by a pressure difference of a water flow formed by the centrifugal blade portion.

An ejection opening through which the water flow discharged through the outlet is ejected into the drum, may be formed at a central part of the pulsator.

Advantageous Effects of Invention

The washing machine according to the present invention may have the following advantages.

Firstly, the pulsator can have a simplified structure, and a water flow of a high ejection pressure can be formed.

Secondly, a small amount of washing water can be used and abrasion of laundry can be reduced, by forming a water flow of a high ejection pressure, and thereby maintaining the level of washing water inside the drum in an equilibrium state.

Thirdly, an twisted state of laundry can be released by ejecting a water flow from the pulsator as an upstream flow.

Fourthly, a washing performance can be enhanced by forming a water flow of a high ejection pressure, and thereby allowing detergent introduced into the drum to circulate more smoothly.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF DRAWINGS

The accompanying drawings, which are included to provide a further understanding of the invention and are incorporated in and constitute a part of this specification, illustrate exemplary embodiments and together with the description serve to explain the principles of the invention.

In the drawings.

MODE FOR THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated.

Figure 1:
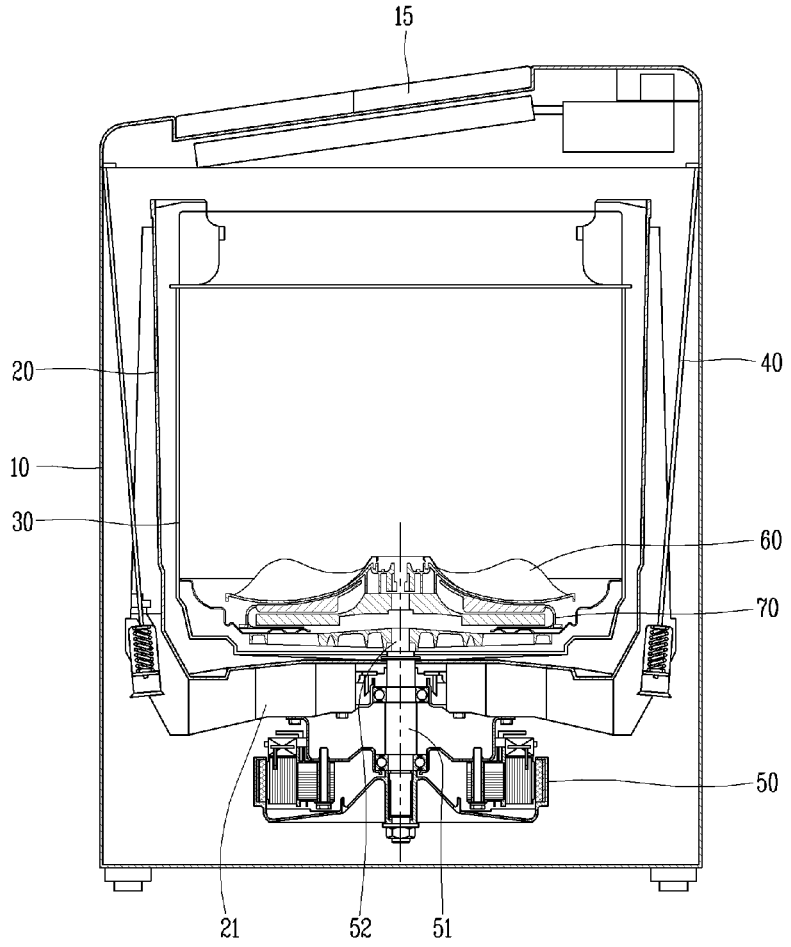
FIG. 1 is a sectional view of a washing machine according to an embodiment of the present invention.

FIG. 1 is a sectional view of a washing machine according to an embodiment of the present invention.

Referring to FIG. 1, the washing machine comprises a cabinet 10 which forms the appearance of the washing machine, a tub 20 disposed in a cabinet, and a drum 30 rotatably disposed in the tub 20.

The cabinet 10 forms the appearance of the washing machine, and is formed in a rectangular parallelepiped shape. However, this is merely exemplary and the present invention is not limited to this.

A door 15 through which laundry is introduced into the drum is provided at an upper side of the cabinet. The tub 20 is formed in a cylindrical shape having an open upper side, and is supported by a suspension bar 40 in the cabinet 10.

The drum 30 is rotatably provided in the tub 20, and is provided with a rotatable pulsator 60 therebelow. The drum 30 and the pulsator 60 are connected to a driving motor 50 to thereby receive a rotational force.

The driving motor 50 is mounted outside a lower surface 21 of the tub 20, and provides a driving force of the drum and the pulsator. The driving motor includes a stator and a rotor. The rotor rotates around the fixed stator, thereby forming a driving force.

To the rotor, connected are a washing shaft 52 connected to the pulsator 60 and rotating the pulsator 60, and a dehydration shaft 51 connected to the drum and rotating the drum. A driving force of the rotor is always transferred to the washing shaft. However, the driving force of the rotor should be transferred to the dehydration shaft by a clutch (not shown). The clutch is configured to selectively transfer a rotational force of the rotor to the dehydration shaft, by being selectively coupled to the rotor while up-down moving.

One end of the washing shaft 52 protrudes towards the inside of the drum via the center of the dehydration shaft 51, and the pulsator is coupled to the protruding end of the washing shaft 52. Another end of the washing shaft downward extends to be coupled to the rotor of the driving motor 50.

The dehydration shaft 51 has a hollow shape, and the washing shaft 52 is penetratingly installed therein in a concentric manner. One end of the dehydration shaft 51 is coupled to the drum, thereby transferring a rotational force to the drum. Another end of the dehydration shaft 51 is selectively coupled to the rotor by a clutch, thereby receiving a rotational force from the rotor.

The pulsator 60 is rotatably provided in the drum. The pulsator may form a water flow by rotation, since it has a shape of a plurality of blades. An ejection hole 61 through which a water flow formed by a water flow forming means to be later explained is ejected into the drum, is formed at a central part of the pulsator.

Figure 2:
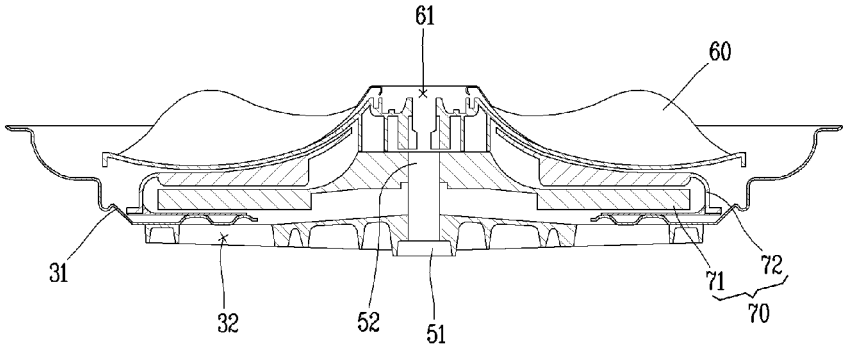
FIG. 2 is a sectional view of a water flow forming means mounted at a drum according to an embodiment of the present invention.

A water flow forming means 70 is provided below the pulsator, and forms a water flow ejected into the drum as an upstream flow. FIG. 2 shows a water flow forming means mounted at a drum according to an embodiment of the present invention. Referring to FIG. 2, the water flow forming means 70 is provided between the pulsator and a lower surface 31 of the drum.

The water flow forming means 70 includes a centrifugal blade portion 71 configured to form an ejection pressure using a centrifugal force by rotation, and a guide portion 72 configured to form a water flow pressurized by the centrifugal blade portion as an upstream flow, and to guide the water flow to be ejected through the pulsator.

Figure 3:
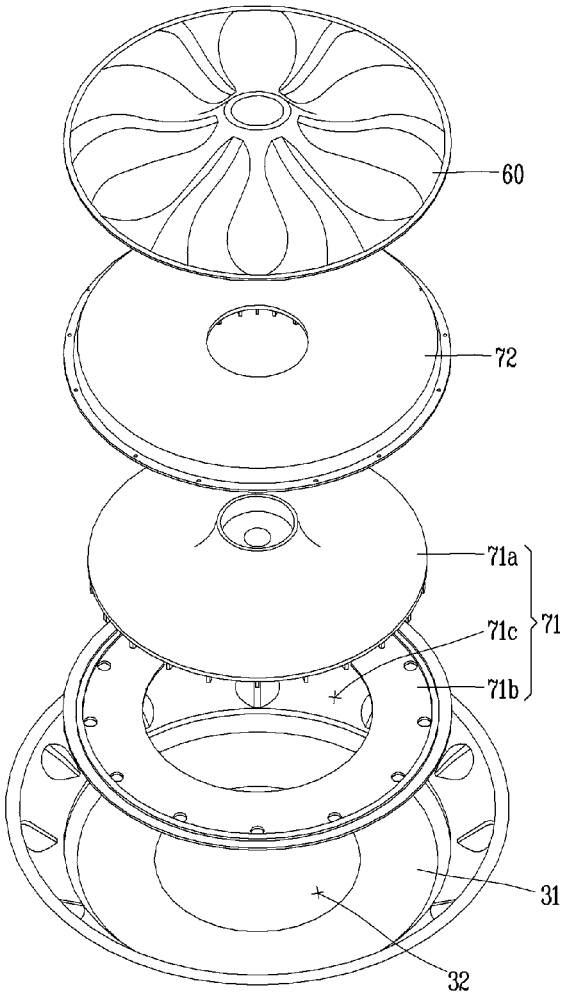
FIG. 3 is a disassembled perspective view of the water flow forming means of FIG. 2.
Figure 4:
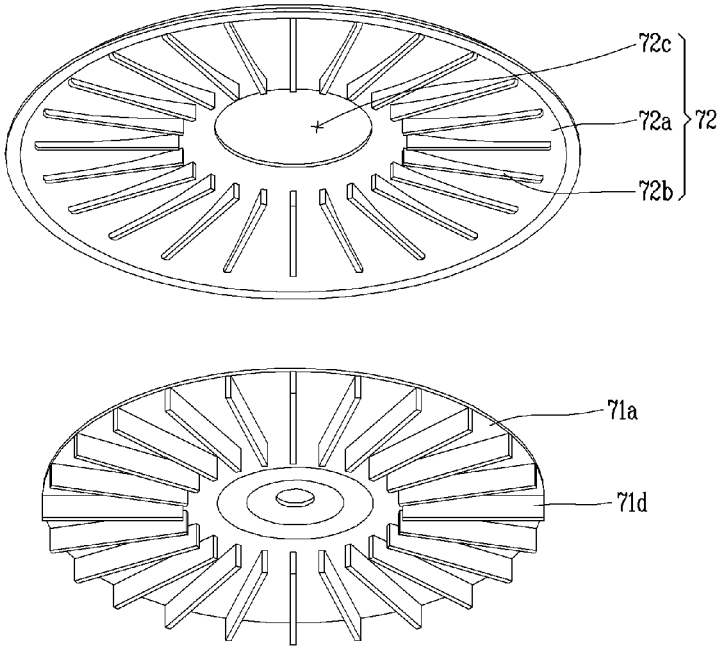
FIG. 4 is a disassembled perspective view of the water flow forming means of FIG. 3, which is viewed from other direction.

FIG. 3 is a disassembled perspective view of the water flow forming means of FIG. 2. FIG. 4 is a disassembled perspective view of the water flow forming means of FIG. 3, which is viewed from other direction. Referring to FIGS. 3 and 4, the centrifugal blade portion includes an upper surface 71*a*, a lower surface 71*b* having an inlet 71*c* at a central part thereof, and a plurality of blades 71*d* extending in a radius direction between the upper surface 71*a* and the lower surface 71*b*. Referring to FIG. 4, the upper surface and the plurality of blades of the centrifugal blade portion are integrally formed.

The centrifugal blade portion 71 is coupled to the washing shaft 52. Accordingly, the centrifugal blade portion 71 and the pulsator 60 are integrally rotated by the driving motor. Washing water passing through the centrifugal blade portion receives a centrifugal force by rotation of the centrifugal blade portion 71, thereby being pressurized in a circumferential direction of the centrifugal blade portion 71.

Washing water is accommodated in the tub. A plurality of holes are formed on the side surface of the drum, so that washing water can flow into the drum through the holes. Referring to FIG. 3, a connection opening 32 through which water between the tub and the drum flows to the inlet 71*c* formed on the lower surface of the centrifugal blade portion, is formed on the lower surface 31 of the drum. Under such configuration, the washing water accommodated in the tub is introduced into the centrifugal blade portion 71 through the connection opening 32 and the inlet 71*c*.

Figure 9:
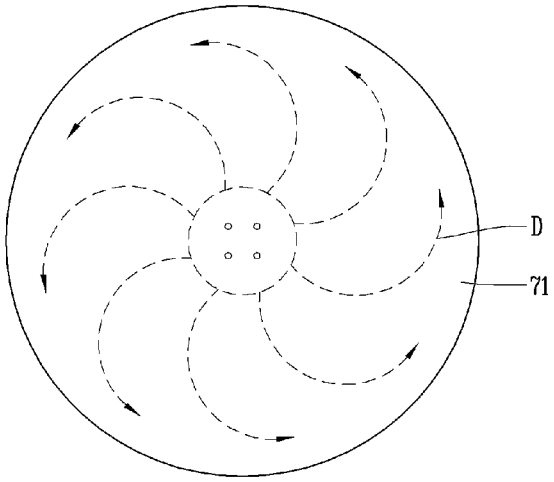
FIG. 9 is a schematic view showing a path of a water flow pressurized in a circumferential direction by rotation of a water flow forming means.

As aforementioned, washing water is pressurized towards a circumferential direction by a centrifugal force of the centrifugal blade portion being rotated. The washing water is guided only to the circumferential direction, by the plurality of blades 71*d* extending in a radius direction between the upper surface 71*a* and the lower surface 71*b* of the centrifugal blade portion. Since the centrifugal blade portion 71 rotates, a water flow guided by the blade 71*d* spirally moves in the circumferential direction as shown in FIG. 9. That is, the water flow formed by the centrifugal blade portion moves in a rotation direction of the centrifugal blade portion 71.

There occurs a pressure difference between the inside and the outside of the connection opening 32 and the inlet 71*c* by pressurization in the circumferential direction due to rotation of the centrifugal blade portion. Accordingly, washing water between the tub and the drum is introduced into the inlet 71*c* through the connection opening 32, by a pressure difference of a water flow formed by the centrifugal blade portion.

Figure 5:
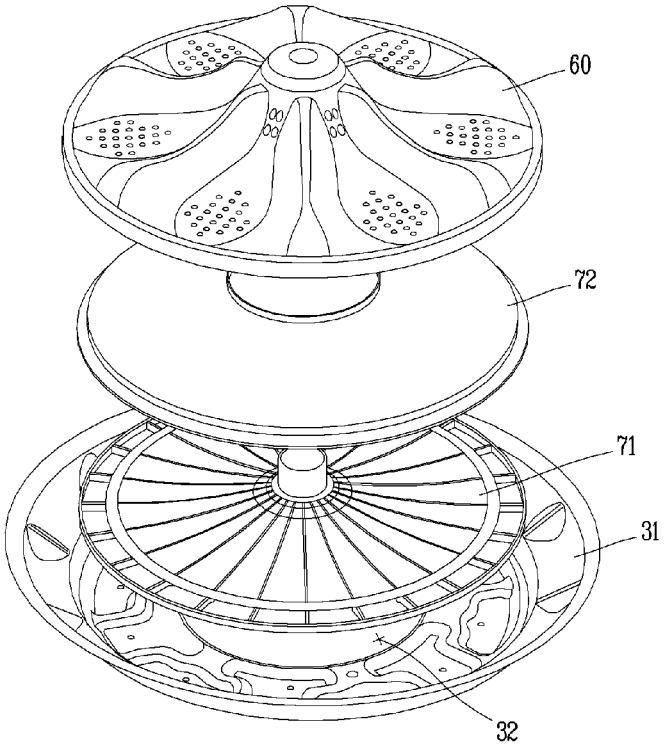
FIGS. 5 and 6 are disassembled perspective views of a water flow forming means according to another embodiment of the present invention.
Figure 6:
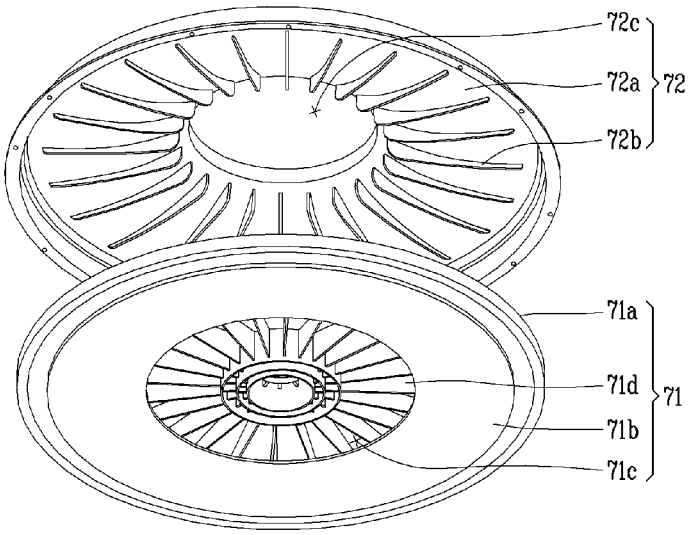

As another embodiment of the water flow forming means, the upper surface 71*a*, the lower surface 71*b* and the plurality of blades 71*d* of the centrifugal blade portion 71 may be integrally formed. Such embodiment is illustrated in FIGS. 5 and 6. Such embodiment is not different from the aforementioned embodiment, except that components of the centrifugal blade portion are integrally formed with each other. More specifically, the integrally-formed centrifugal blade portion 71 is connected to the washing shaft 52 to thereby be integrally rotated with the pulsator 60. And, washing water is introduced through the connection opening 32 formed on the lower surface 31 of the drum, and the inlet 71*c* of the centrifugal blade portion. Then, the washing water is pressurized in the circumferential direction by rotation of the centrifugal blade portion, thereby forming a water flow.

The guide portion 72 is configured to form a water flow pressurized by the centrifugal blade portion as an upstream flow, and to guide the water flow to be ejected through the pulsator. Referring to FIG. 3, the centrifugal blade portion is mounted to an inner lower side of the guide portion. Accordingly, the guide portion 72 is positioned between the pulsator 60 and the centrifugal blade portion 71.

Referring to FIG. 4, the guide portion 72 includes a body portion 72*a* having a disc shape, an outlet 72*c* formed at a central part of the body portion 72*a*, and a plurality of guide blades 72*b* protruding towards the centrifugal blade portion at the periphery of the outlet, and extending in the radial direction.

A water flow pressurized in the circumferential direction by the centrifugal blade portion 71 is formed as an upstream flow by the guide blades 72*b*, and is discharged through the outlet 72*c*.

That is, a water flow pressurized towards the circumferential direction is discharged to part between the upper surface 71*a* of the centrifugal blade portion and the guide portion 72, at a space between the upper surface 71*a* and the lower surface 71*c* of the centrifugal blade portion, on the circumference of the centrifugal blade portion.

Referring to FIG. 2, the guide portion 72 is formed to enclose the upper surface and the side surface of the centrifugal blade portion 71. Accordingly, a water flow discharged from the circumference of the centrifugal blade portion flows along the lower surface of the body portion 72*a* of the guide portion 72.

The plurality of guide blades 72*b* protrude towards the centrifugal blade portion at the periphery of the outlet, and extend in the radial direction. Accordingly, a water flow discharged from the circumference of the centrifugal blade portion, flows to the outlet 72*c* by the guide blades 72*b*.

As aforementioned, the centrifugal blade portion and the pulsator are integrally rotated by the driving motor. However, the guide portion is fixed to the drum, and is independently rotated from the centrifugal blade portion and the pulsator. That is, the guide portion is integrally rotated with the drum by being connected to the lower surface 31 of the drum. However, the guide portion is independently rotated from the pulsator and the centrifugal blade portion. If the drum and the pulsator are integrally rotated as the dehydration shaft is connected to the rotor of the driving motor by a clutch during a dehydration process, the guide portion may be integrally rotated with the centrifugal blade portion and the pulsator. However, the guide portion is independently rotated from the pulsator and the centrifugal blade portion during a washing process.

Accordingly, a water flow pressurized, rotated and discharged in the circumferential direction of the centrifugal blade portion, flows along the guide blades 72*b* of the fixed guide portion. Then, the water flow is converted into an upstream flow. The water flow converted into an upstream flow is ejected into the drum via the outlet 72*c* and the ejection hole 61 of the pulsator, sequentially.

In the present invention, there is provided the guide portion fixed to the drum, and independently rotated from the centrifugal blade portion and the pulsator. Through the guide portion, a water flow pressurized by a centrifugal force due to rotation of the centrifugal blade portion, is converted into an upstream flow having a high ejection pressure.

Generally, a rotating water flow spreads out by a centrifugal force. This may cause a difficulty in forming a high ejection pressure in a vertical direction such as an upstream flow. Under the configuration of the present invention, a water flow having a high ejection pressure can be formed in a simplified structure.

Figure 7:
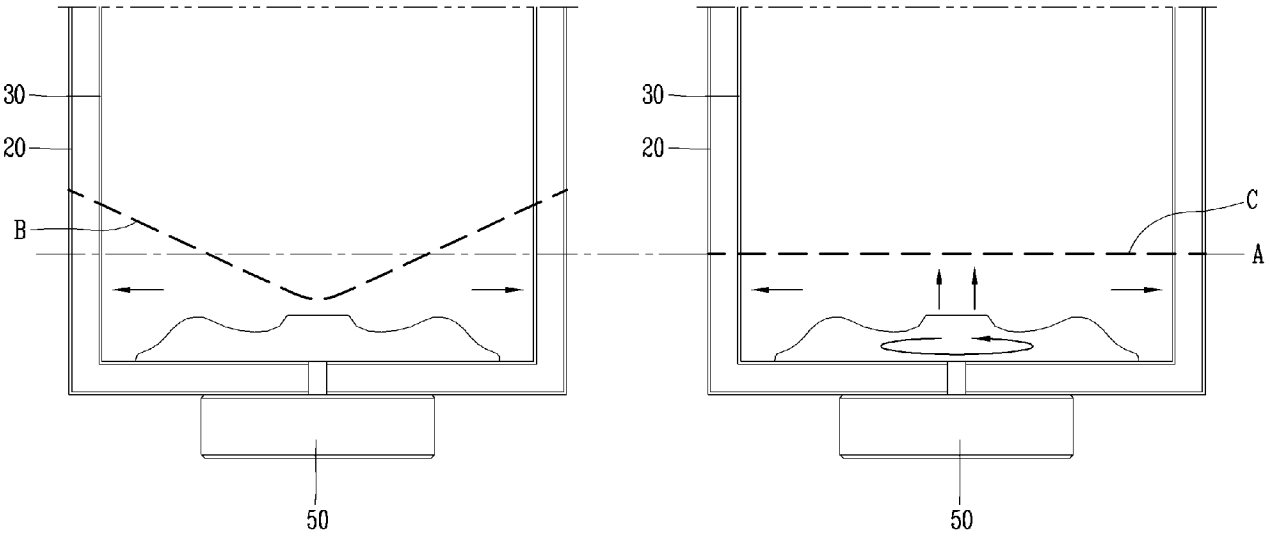
FIG. 7 is a schematic view which compares a water level inside a drum by rotation of a pulsator, with a water level compensated by a water flow forming means.

Washing water in the drum forms a water flow rotated by rotation of the pulsator. As a result, the water level in the drum in the circumferential direction is higher than that in the central direction. Referring to the left drawing of FIG. 7, the water level (B) in the drum in the circumferential direction is higher than the reference level (A) in the central direction, due to rotation of the pulsator.

If a small amount of washing water is used, the laundry may be exposed to the outside or may be abraded by friction with the inner surface of the drum. Furthermore, the water level in the drum may be lowered or become uneven, because the washing water in the drum flows to the tub.

Under the configuration of the present invention, if a water flow of a high ejection pressure is ejected towards a central part of the drum, the amount of washing water to be introduced into the central part of the drum is increased. As a result, the water level (C) in the drum is consistent with the reference level (A). Furthermore, the washing water discharged to the tub by a water pressure difference due to rotation of the centrifugal blade portion, is introduced into the water flow forming means to thereby be re-ejected into the drum. This may allow the water level in the tub to be low, but the water level in the drum to be high. As a result, a small amount of washing water can be used, and the water level in the drum can be even to thereby reduce abrasion of the laundry.

In the present invention, an entangled state of the laundry can be released as a water flow ejected from the pulsator is converted into an upstream flow. Generally, the laundry in the drum may be in an entangled state by a rotating water flow. If the laundry comes in contact with an upstream flow, rotation of the contact part of the laundry is reduced. As a result, the entangled state of the laundry is released.

Figure 8:
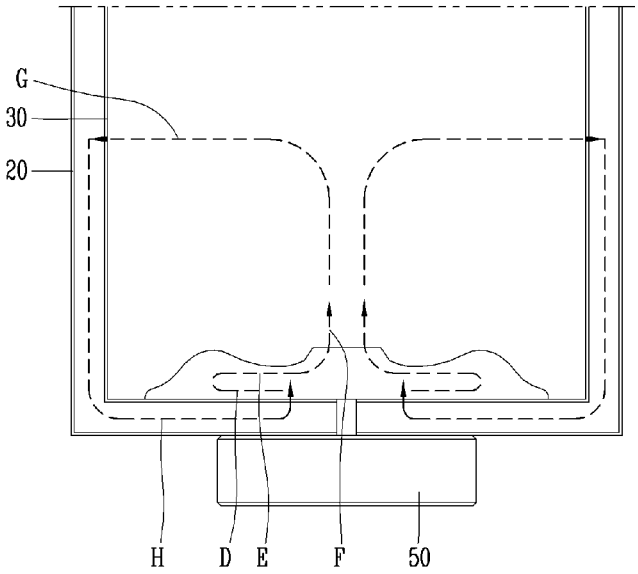
FIG. 8 is a schematic view showing a circulation path of washing water formed in a drum and a tub by a water flow forming means.

FIG. 8 is a schematic view showing a circulation path of washing water formed in a drum and a tub by a water flow forming means. The water flow (E) implemented as an upstream flow by the guide portion, is ejected into the drum. ('F') The washing water in the drum moves to the tub ('G') by a water flow formed by rotation of the pulsator. The washing water having moved to the tub, is introduced to the water flow forming means ('H') by a water pressure difference generated by the aforementioned a water flow forming means. Then, the washing water is pressurized (D) in the circumferential direction by rotation of the centrifugal blade portion, and is converted into an upstream flow through the guide portion. In this case, the water flow pressurized in the circumferential direction by the centrifugal blade portion forms a water flow which rotates in a spiral shape as shown in FIG. 9, and is converted into an upstream flow through the guide portion. Therefore, the more a water flow having a high ejection pressure is formed, the more washing water in the drum circulates. This may allow detergent introduced into the drum to more smoothly circulate, thereby enhancing a washing function.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

The invention claimed is:

1. A washing machine, comprising:
- a cabinet;
- a tub provided in the cabinet;
- a drum rotatably provided in the tub;
- a pulsator, rotatably provided in the drum;
- a driving motor mounted outside the tub, and rotating the drum and the pulsator; and
- a water flow forming means provided below the pulsator, comprising:
  - a guide portion with an outlet formed at a central part thereof and a plurality of guide blades circumferentially arranged around the outlet and extending in a radial direction away from the outlet, and
  - a centrifugal blade portion mounted to a lower side of the guide portion;
- wherein the water flow forming means is configured to form a water flow ejected into the drum as an upstream flow.

2. The washing machine of claim 1, wherein the
- centrifugal blade portion is configured to form an ejection pressure using a centrifugal force; and
- wherein the guide portion is configured to guide a water flow pressurized by the centrifugal blade portion to be ejected through the pulsator.

3. The washing machine of claim 2, wherein the centrifugal blade portion and the pulsator are integrally rotated by the driving motor, and
- wherein the guide portion is fixed to the drum, and is independently rotated from the centrifugal blade portion and the pulsator.

4. The washing machine of claim 3, wherein the centrifugal blade portion comprises:
- an upper surface;
- a lower surface having an inlet at a central part thereof; and
- a plurality of blades extending in a radial direction between the upper surface and the lower surface, such that water introduced through the inlet is guided to a circumferential direction,
- wherein the centrifugal blade portion pressurizes water by rotation thereof.

5. The washing machine of claim 4, wherein the
- plurality of guide blades are protruded towards the centrifugal blade portion.

6. The washing machine of claim 5, wherein a connection opening through which water between the tub and the drum flows to the inlet, is formed on a lower surface of the drum.

7. The washing machine of claim 6, wherein the water between the tub and the drum flows to the inlet through the connection opening, by a pressure difference of a water flow formed by the centrifugal blade portion.

8. The washing machine of claim 5, wherein an ejection opening through which the water flow discharged through the outlet is ejected into the drum, is formed at a central part of the pulsator.

9. The washing machine of claim 4, wherein the upper surface and the plurality of blades of the centrifugal blade portion are integrally formed.

10. The washing machine of claim 4, wherein the upper surface, the lower surface, and the plurality of blades are integrally formed.

* * * * *